US005752365A

United States Patent [19]

Johnson et al.

[11] Patent Number: 5,752,365

[45] Date of Patent: May 19, 1998

[54] APPARATUS AND METHODS FOR INSERTING PREMIUM ITEMS

[75] Inventors: Bruce R. Johnson, Plymouth, Minn.; H. Douglas Flom, New Richmond, Wis.

[73] Assignee: General Mills, Inc., Minneapolis, Minn.

[21] Appl. No.: 761,911

[22] Filed: Dec. 9, 1996

[51] Int. Cl.[6] ..... B65B 63/00

[52] U.S. Cl. ..... 53/435; 53/55; 53/389.2; 53/389.3

[58] Field of Search ..... 83/110, 112, 155.1, 83/345, 945; 53/435, 389.3, 389.2, 55, 249, 520, 374.4

[56] References Cited

U.S. PATENT DOCUMENTS

| | | | |
|---|---|---|---|
| 3,898,900 | 8/1975 | Schmermund . | |
| 4,010,981 | 3/1977 | Hodge . | |
| 4,240,336 | 12/1980 | Grevich et al. . | |
| 4,305,240 | 12/1981 | Grevich et al. . | |
| 4,336,680 | 6/1982 | Grevich . | |
| 4,362,593 | 12/1982 | Grevich . | |
| 4,506,488 | 3/1985 | Matt et al. . | |
| 4,507,906 | 4/1985 | Meyer . | |
| 4,525,977 | 7/1985 | Matt . | |
| 4,546,594 | 10/1985 | Mohaupt . | |
| 4,546,597 | 10/1985 | Denker . | |
| 4,549,386 | 10/1985 | Wilson | 53/374.4 |
| 4,553,368 | 11/1985 | Ziller . | |
| 4,574,566 | 3/1986 | Eaves et al. . | |
| 4,640,408 | 2/1987 | Eaves . | |
| 4,681,002 | 7/1987 | Nakaya | 83/155.1 |
| 4,696,244 | 9/1987 | Sampson et al. . | |
| 4,722,168 | 2/1988 | Heaney . | |
| 4,759,433 | 7/1988 | Kraft . | |
| 4,848,974 | 7/1989 | Wayt . | |
| 4,874,273 | 10/1989 | Tokisue et al. . | |
| 4,889,224 | 12/1989 | Denker . | |
| 5,001,951 | 3/1991 | Eisenlohr et al. | 83/155.1 |
| 5,014,582 | 5/1991 | Teik | 83/110 |
| 5,034,087 | 7/1991 | Denker et al. . | |
| 5,034,088 | 7/1991 | Denker . | |

(List continued on next page.)

FOREIGN PATENT DOCUMENTS

| | | | |
|---|---|---|---|
| 6144424 | 11/1992 | Japan | 53/389.3 |
| 2262079 | 6/1993 | United Kingdom | 53/374.4 |

OTHER PUBLICATIONS

DOBOY®, Super Mustang Horizontal Wrapper Model Super M, FCSP SM-5M-2/79.

DOBOY®, p. 2 of 1981 Card Sheeter Manual.

DOBOY®, SK Super Mustang brochure, one page, ©1983.

DOBOY® SK Horizontal Wrapper Overview, one page, date unknown.

*Primary Examiner*—James F. Coan
*Assistant Examiner*—Gene L. Kim
*Attorney, Agent, or Firm*—John A. O'Toole; L. MeRoy Lillehaugen; Alan D. Kamrath

[57] ABSTRACT

A bandolier (20) of serially connected premium items (18) are fed by a vacuum conveyor (26) to a rotary cutter (14), with the bandolier (20) being sandwiched against the vacuum conveyor (26) by an overhead conveyor (32). The shaft (40) of the rotary cutter (14) is rotated by a servo-motor (42) such that its blade (46) engages the bandolier (20) with a linear speed which cuts the initial item (18) from the bandolier (20) and pushes and accelerates the cut item (18) into a carton (52) moving in a carton path (53). The linear speed of the bandolier (20) in the feed path (27) is tied to the linear speed of the cartons (52) in the carton path (53) while rotation of the shaft (40) is controlled by an optical sensor (38) which senses movement of the bandolier (20) by the vacuum conveyor (26). If movement of the bandolier (20) slows or is stopped, the shaft (40) is held in a control position so that the servo-motor (42) is able to accelerate the shaft (40) so that it reaches the linear speed required to accelerate the cut item (18) when the blade (46) reaches the cutting position independent of the linear speed of the bandolier (20).

43 Claims, 4 Drawing Sheets

U.S. PATENT DOCUMENTS 5,079,901 1/1992 Kotsiopoulos .
5,138,815 8/1992 Groschen, Jr. .
5,186,313 2/1993 Denker et al. .
5,205,991 4/1993 Avery et al. .
5,279,095 1/1994 Muller ..... 53/386.1
5,378,304 1/1995 Denker .
5,415,592 5/1995 Hoyt .
5,425,217 6/1995 Lobash et al. .
5,477,656 12/1995 Loewenthal ..... 53/389.3
5,588,280 12/1996 Kotsiopoulos .

APPARATUS AND METHODS FOR INSERTING PREMIUM ITEMS

BACKGROUND

The present invention generally relates to apparatus and methods for dispensing items fabricated into and/or cut from bandolier, specifically relates to apparatus and methods for inserting items into packaging, and in the most preferred form relates to apparatus and methods for inserting both two and three dimensional premium items into packaging.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

It can then be appreciated that customer dissatisfaction and complaints can arise if the printing located on the exterior of the box indicates that a promotional device is present when in fact for that particular box, the promotional device was omitted for whatever reason. In fact, such causes of customer dissatisfaction may actually reduce the marketability of the product if occurring frequently.

It can be appreciated that promotional devices can be placed in the boxes manually. Although greatly reducing the chance of omission or misplacement of the promotional devices, such manual placement is relatively expensive in both the labor required but also in the disruption of the normal handling of the product. Automatic placement by mechanical means is less costly in both labor and disruption of normal handling, but typically increases the possibility of omission or misplacement of the promotional device in the packaging.

U.S. Pat. No. 5,425,217 discloses apparatus and methods for inserting flat premium items and represented a major improvement in the field of the mechanical placement of premium items in packaging. However, its methodology is generally limited to the placement of flat premiums and has special applicability for the placement of coupons. Thus, the teachings of U.S. Pat. No. 5,425,217 may not be applicable to many three dimensional premiums such as but not limited to candy bars, packages of gum, figurines, and the like.

Other forms of mechanical placement of premium items and especially three dimensional premiums include providing the premiums in a bandolier having an indexing notch for each premium item. A feeding mechanism having a plug engaging the indexing notches in the bandolier feeds the bandolier to a reciprocating knife which cuts the individual premium items from the bandolier. A pick and place mechanism then takes the severed premium item and inserts it into the packaging. As an example, a pick and place mechanism could be in the form of a suction cup which is moved from a first position for picking up an individual premium item to an offset position where vacuum is discontinued so that the suction cup releases the premium item which drops into the package directly or into a conveyor or like receptacle where it is later pushed into the package.

These and similar forms of mechanical placement machines have many deficiences. First, packaging machines can operate at speeds of up to about 150 cartons per minute whereas mechanical placement of premium items can typically only operate at speeds of up to about 60 cartons per minute. Thus, three mechanical placement machines are utilized with each packaging machine for inserting premium items in every third carton in the packaging machine. In addition to the expense of three machines, the floor space requirements for three machines as well as for the increased length of the packaging machine to accommodate three machines in series is greatly increased.

Moreover, prior mechanical placement machines are extremely mechanically complicated and are subject to a great deal of operating problems. As it is desired that premium items be inserted in every package, the whole production line must be slowed or stopped any time any one of the mechanical placement machines experiences trouble, thus greatly reducing production. It has been estimated that efficiency losses of 2 to 5% occur because of downtime for the mechanical placement machines. Further, a full time operator is often needed just to operate the three mechanical placement machines, thus increasing operating costs. Additionally, because many of the components in mechanical placement machines have movement in different directions such as back and forth and do not move continuously in the same direction, such mechanical placement machines are a major source of vibration, which in addition to limiting speeds of operation of the mechanical placement machines themselves, can also be transmitted to the packaging machines and negatively affecting performance thereof.

It is thus an object of the present invention to provide novel apparatus and methods for inserting items that can be fabricated into and/or cut from a bandolier.

Another object of the present invention is to provide such novel item insertion apparatus and methods for inserting items in packaging.

Yet another object of the present invention is to provide such novel item insertion apparatus and methods for inserting premium items.

It is still further an object of the present invention to provide such novel item insertion apparatus and methods for inserting both two and three dimensional items.

It is still further an object of the present invention to provide such novel item insertion apparatus and methods operable at speeds at least comparable to packaging machines.

It is still further an object of the present invention to provide such novel item insertion apparatus and methods providing positive control during the placement of the item.

It is still further an object of the present invention to provide such novel item insertion apparatus and methods including sensors to insure the placement of the item.

It is still further an object of the present invention to provide such novel item insertion apparatus which is not a significant source of vibration.

It is still further an object of the present invention to provide such novel item insertion apparatus of a simple mechanical design.

It is still further an object of the present invention to provide such novel item insertion apparatus and methods minimizing the floor space required for premium insertion.

It is still further an object of the present invention to provide such novel item insertion apparatus and methods experiencing minimal operational problems and requiring minimal operator supervision.

It is still further an object of the present invention to provide such novel item insertion apparatus and methods for inserting pouches or packets.

It is still further an object of the present invention to provide such novel item insertion apparatus and methods having special application in the food industry.

It is still further an object of the present invention to provide such novel item insertion apparatus and methods generally applicable to environments where placement of items into a production path at accurate intervals is desired.

SUMMARY

Surprisingly, the above objects and other aims can be satisfied in the field of the insertion of items into a production path at accurate intervals such as into packaging by providing, in a first aspect of the preferred form of the present invention, a rotary cutter including a shaft which is rotated such that a blade engages at least one bandolier being fed in a feed path between the trailing edge of the initial item and the leading edge of the next item in the bandolier to cut the initial item from the bandolier and to push and accelerate the cut item.

In preferred aspects of the present invention, the linear feed speed of the bandolier is related to the linear speed of cartons moving in a production path intersecting with the path of the bandolier and to the presence of defective cartons interspersed with satisfactory cartons in the production path and rotation of the rotary cutter is under the control of an optical sensor which senses movement of the bandolier.

In still other aspects of the present invention, the blade is positioned on the shaft of the rotary cutter so that the shaft can be rotated and the bandolier in the form of three-dimensional objects mounted to a carrier can be fed without engagement of the blade with the three-dimensional objects.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
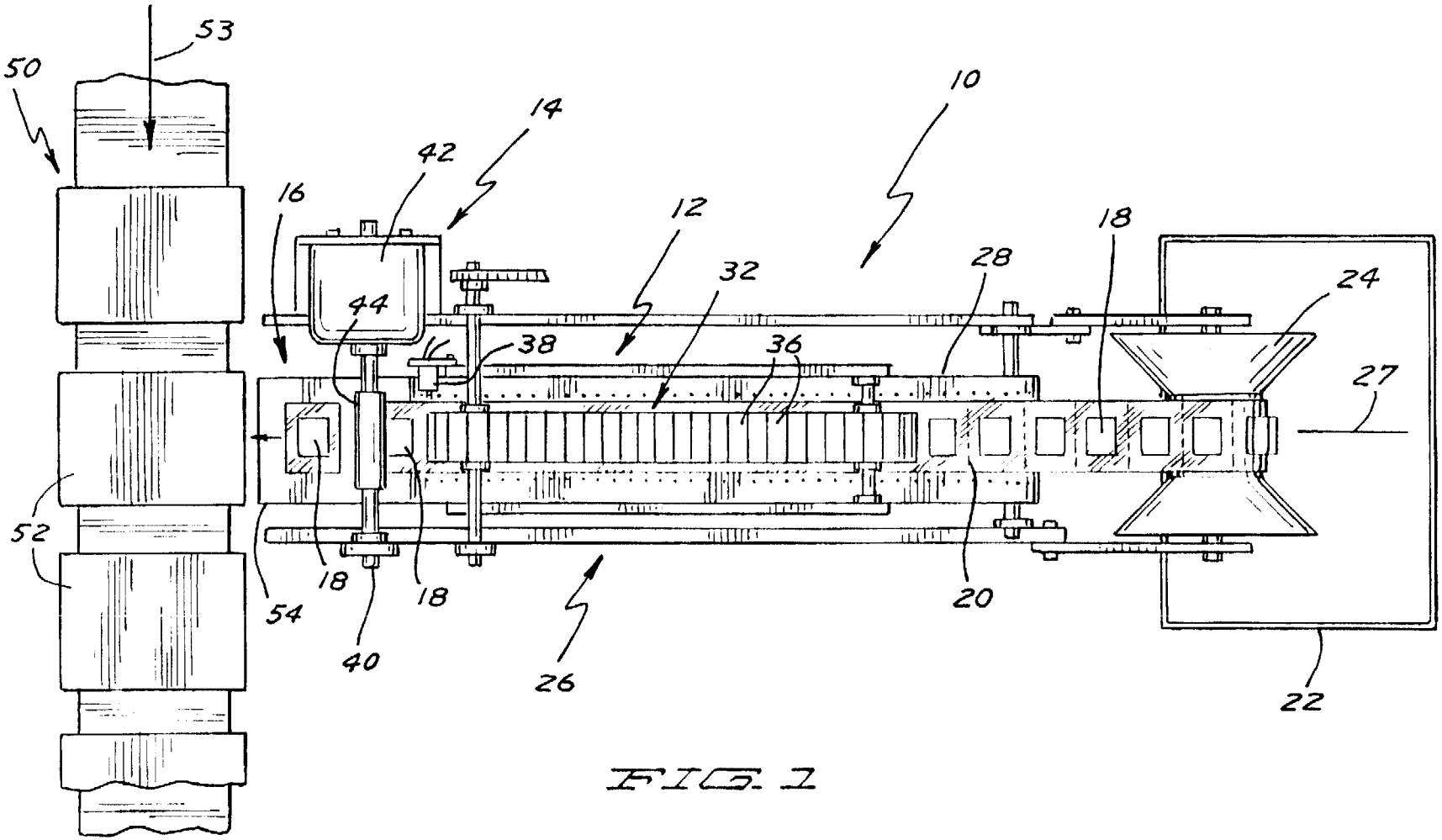
FIG. 1 shows a diagrammatic top view of the inserting apparatus utilizing the methods of the preferred forms according to the teachings of the present invention.

All figures are drawn for ease of explanation of the basic teachings of the present invention only; the extensions of the Figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "upper", "lower", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the preferred embodiments.

DESCRIPTION

Apparatus for inserting premium and other items at accurate intervals into a production path such as into a package according to the preferred teachings of the present invention is shown in the drawings and generally designated 10. In the most preferred form, apparatus 10 generally includes a feed section 12, a cutting and accelerating section 14 and a delivery section 16. In particular, premium items 18 are supplied connected together in a serial manner in a continuous strip or bandolier 20 having the leading edge of premium item 18 integrally connected or secured to the trailing edge of the preceding premium item 18.

In the preferred form, bandolier 20 generally includes a continuous longitudinally elongated carrier in the most preferred form of an overwrapping material 122 including a bottom surface or strip 124 which is generally in the same plane and a top surface or strip 126. In the preferred form, top strip 126 is formed by first and second portions having longitudinal edges integrally connected to the respective longitudinal side edges of bottom strip 124 and having their free edges sealed together along a longitudinally extending, center fin seal. A plurality of longitudinally spaced premiums 128 are located intermediate top and bottom strips 124 and 126. In the most preferred form, bandolier 20 includes a trailing and a leading seal 130 and 132 extending between the side edges of strips 124 and 126 and located intermediate premiums 128. In the most preferred form, seals 130 and 132 are in a spaced, parallel relation, with the trailing edge of a first premium item 18 and the leading edge of the next premium item 18 located intermediate seals 130 and 132. However, it can be appreciated that seals 130 and 132 can be formed continuous without spacing rather than being spaced as in the preferred form. Additionally, strips 124 and 126 can be suitably sealed or adhered together around and to premium 128 or can be free of attachment. Overwrapping material 122 prevents the flavor, color or odor of premium 128 from leaking into the breakfast cereal or similar product with which it is packaged.

Premium items 18 can be generally two-dimensional such as when premium 128 is in the form of sports cards, coupons, or similar printed material. Additionally, premium items 18 can be three-dimensional such as when premium 128 is in the form of a candy bar, a package of gum, a figurine, or the like. Top strip 126 can be in generally the same plane such as in the case of two-dimensional premiums 128 or can be in varying planes such as where overwrapping material 122 is in the form of bubbles extending over three-dimensional premiums 128.

It should be appreciated that bandolier 20 can take other forms according to the teachings of the present invention. As an example, bandolier 20 can be in the form of a bottom strip 124 with premiums 128 suitably mounted and secured thereto without top strip 126. Likewise, bandolier 20 could be in the form of premiums 128 which are integrally connected together without use of an overwrapping or similar carrier material 122. similarly, premiums 128 could be in the form of printing, engraving, etching, or the like directly on bottom strip 124 to form coupons and the like.

Feed section 12 generally includes a source 22 for at least one bandolier 20. In the preferred form, bandoliers 20 are prefabricated and are provided in a shipping tote 22 removably placed adjacent to apparatus 10. At least one bandolier 20 is fed from tote 22 over a first passive idler wheel 24 and onto a vacuum conveyor 26. Vacuum conveyor 26 generally feeds bandolier 20 in a feed direction along a feed path 27 and at a linear feed speed in feed path 27. Particularly, conveyor 26 generally includes a continuous belt 28 including an array of apertures extending therethrough. Belt 28 passes over a vacuum box 30 which is under vacuum. Thus, the vacuum tends to draw and hold any articles on the top surface of belt 28 and in apparatus 10 capturing bandolier 20 against the top surface of belt 28 which conveys bandolier 20 towards section 14.

Idler wheel 24 generally acts as a guide for insuring that bandolier 20 is placed within the longitudinal edges of belt 28 and extends in a generally longitudinal direction onto vacuum conveyor 26. Additionally, in the preferred form, with bandolier 20 being conveyed in feed path 27 generally horizontally on vacuum conveyor 26, idler wheel 24 helps bandolier 20 to change direction from tote 22 located vertically below feed path 27 and also helps to insure that bandolier 20 is placed on vacuum conveyor 26 in a serial manner and not in any way tangled.

Additionally, it should be appreciated that bandolier 20 may not lay flat on conveyor 26. As an example, overwrapping material 122 may tend to have a memory to retain the shape it had in tote 22 especially if stored for relatively long periods of time. Specifically, if bandolier 20 or portions thereof are stored in a spiraled or rolled condition, an individual premium item 18 between its leading and trailing edges or longitudinal sections of bandolier 20 may retain an arcuate shape after placement on vacuum conveyor 26 through idler wheel 24. If problems of bandolier 20 not laying flat on vacuum conveyor 26 arise, feed section 12 can include suitable provisions 32 for pressing against the top surface of bandolier 20 while on vacuum conveyor 26 to thereby sandwich bandolier 20 on the top surface of belt 28. In the most preferred form, provisions 32 are in the form of an overhead conveyor generally including a continuous capture belt 34 driven to have its lower surface at a linear speed equal to that of belt 28 extending over vacuum box 30. Belt 34 carries suitable elements 36 for engaging with top surface 126 of bandolier 20. As examples, elements 36 could be in the form of compressible closed cell foam blocks having longitudinal lengths either the same as or different than the longitudinal lengths of individual premium items 18 in bandolier 20 or in the form of inverted cups having edges which abut bandolier 20 between premiums 128 and including cavities of a size and shape for receiving one or more premiums 128 in bandolier 20. It should be appreciated that once bandolier 20 has been pushed downwardly on vacuum conveyor 26 such that bottom surface 124 of bandolier 20 generally flushly abuts with belt 28, bandolier 20 will be captured and held flushly against belt 28 due to vacuum box 30 even after top surface 126 of bandolier 20 is no longer being pushed by provisions 32.

Feed section 12 further includes an optical sensor 38 for sensing movement of each bandolier 20 in feed path 27 by sensing individual premium items 18 in bandolier 20 located on vacuum box 30. In case of premiums 128 of a three-dimensional configuration, sensor 38 can be arranged laterally with respect to and in the plane of path 27 of bandolier 20 to sense the thickness of premiums 128. Alternately or in the event that premium items 18 are of a two-dimensional configuration, optical sensor 38 can be arranged perpendicular to the plane of path 27 of bandolier 20 to sense eye spots such as printed on overwrapping material 122 at the interconnection between individual premium items 18 or to sense other photoelectrically distinguishing features of the individual premiums 128 or premium items 18.

Section 14 is in the preferred form of a rotary cutter and generally includes a shaft 40 which is rotatably mounted about an axis extending laterally with respect to bandolier 20 and parallel to and spaced above the plane of path 27 of bandolier 20. Shaft 40 is rotated by a servo-motor 42. A blade holder 44 is secured to shaft 40 for rotation therewith. At least a first blade 46 is secured to blade holder 44 and extends generally laterally across feed path 27 of bandolier 20 and parallel to the plane of path 27 of bandolier 20 and to the leading and trailing edges of premium items 18. System 14 further includes an anvil 48 arranged below and for supporting bottom surface 124 of bandolier 20. It can be appreciated that bandolier 20 is cut by blade 46 when engaged by blade 46 between trailing seal 130 of the initial item 18 and leading seal 132 of the next item 18 by sandwiching bandolier 20 between anvil 48 and blade 46 at its cutting position. Anvil 48 in the preferred form is shown as being of a stationary type. However, it can be appreciated that anvil 48 can have other forms and constructions including but not limited to of the rotary type.

According to the teachings of the present invention, the linear speed of blade 46 at its cutting position when cutting bandolier 20 at anvil 48 is substantially greater than the linear speed of belt 28 passing over vacuum box 30 and thus of bandolier 20 in feed path 27. It should be appreciated that as an individual premium item 18 is cut from bandolier 20, blade 46 pushes the trailing edge of premium item 18 to accelerate or shoot cut premium item 18 forward in an acceleration direction perpendicular to blade 46 from the linear speed of bandolier 20 to generally the linear speed of blade 46 at anvil 48. In the most preferred form, where seals 130 and 132, the trailing and leading edges of premium item 18 and blade 46 extend generally perpendicular to feed path 27, the acceleration direction is generally contiguous to the feed direction of bandolier 20 in feed path 27.

Figure 2:
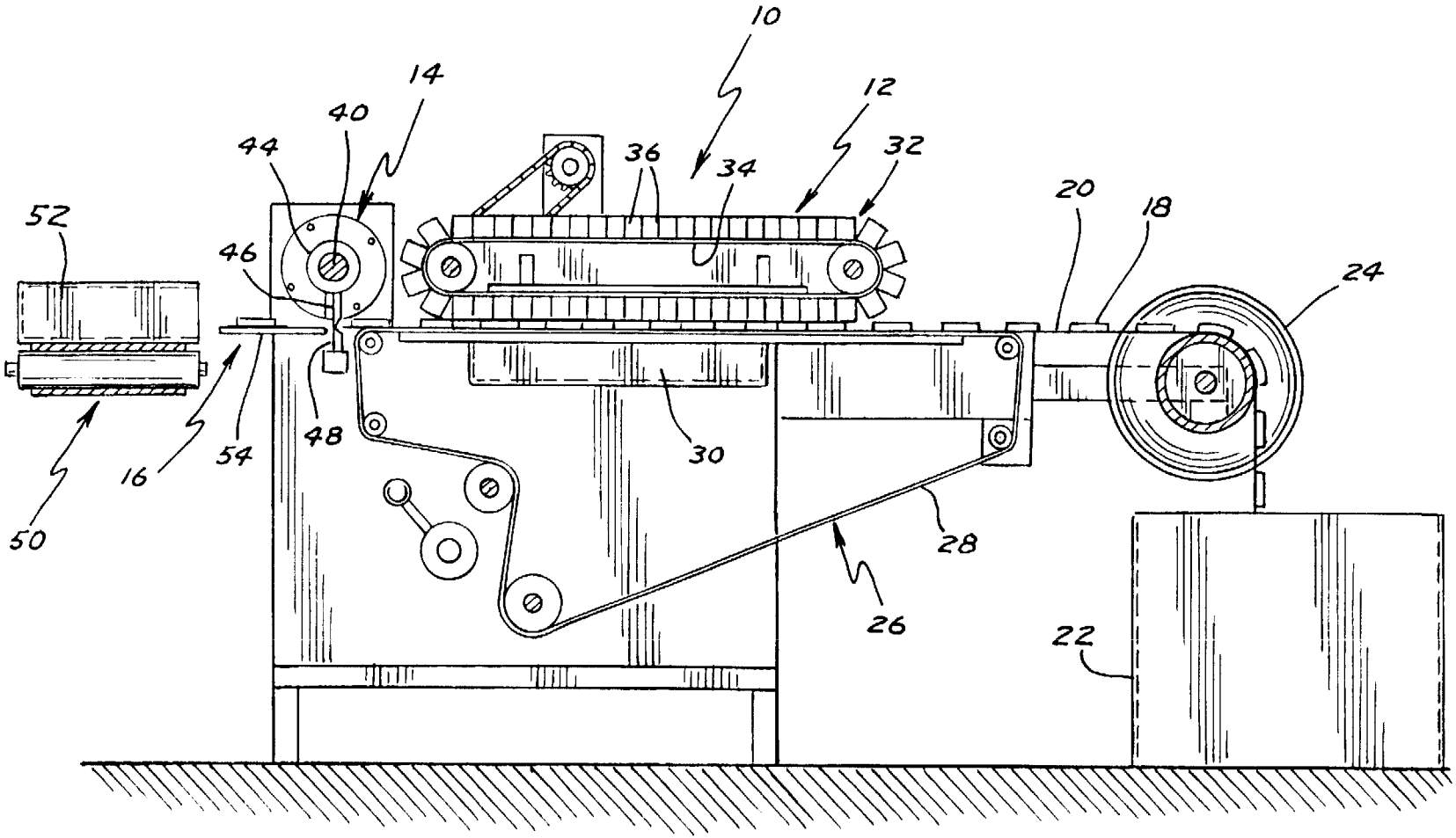
FIG. 2 shows a diagrammatic front view of the inserting apparatus of FIG. 1.
Figure 3:
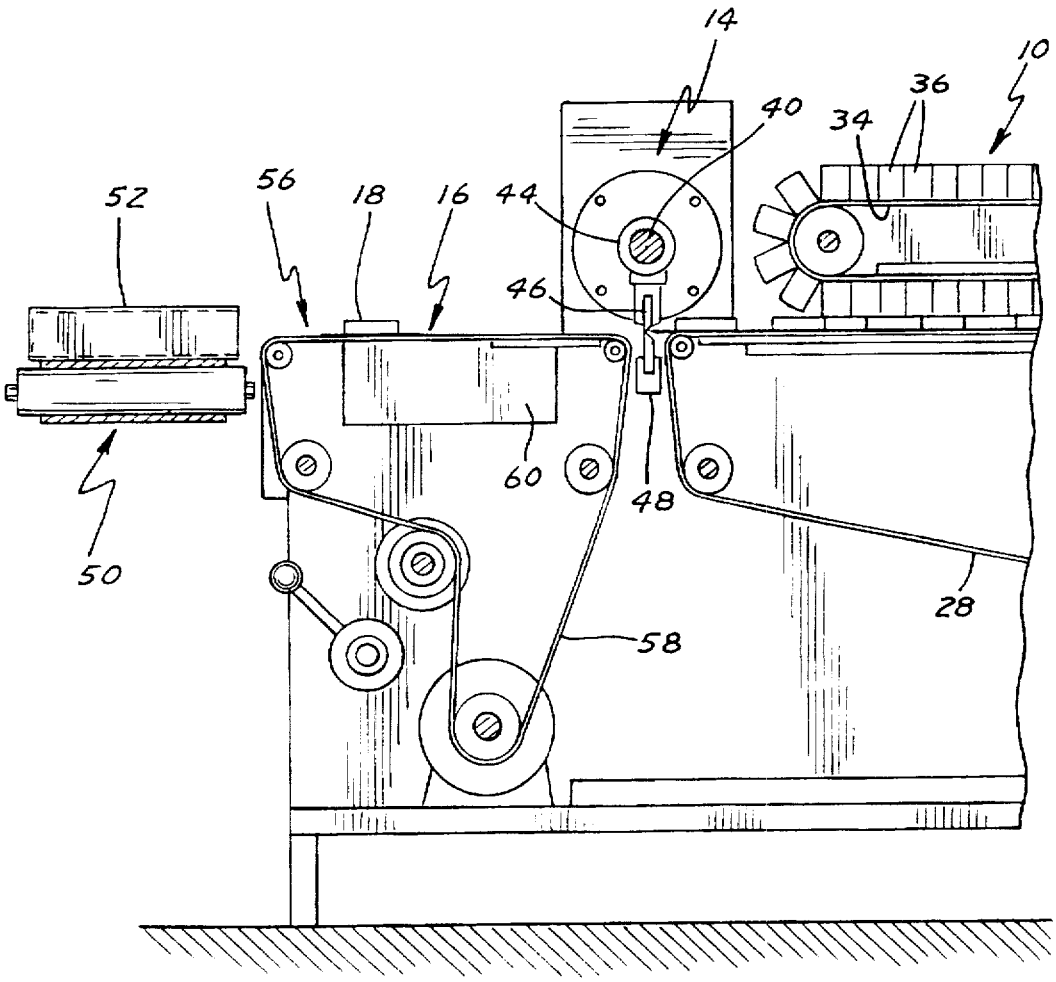
FIG. 3 shows a partial, diagrammatic front view of an alternate form of the inserting apparatus of FIG. 1 according to the teachings of the present invention.
Figure 4:
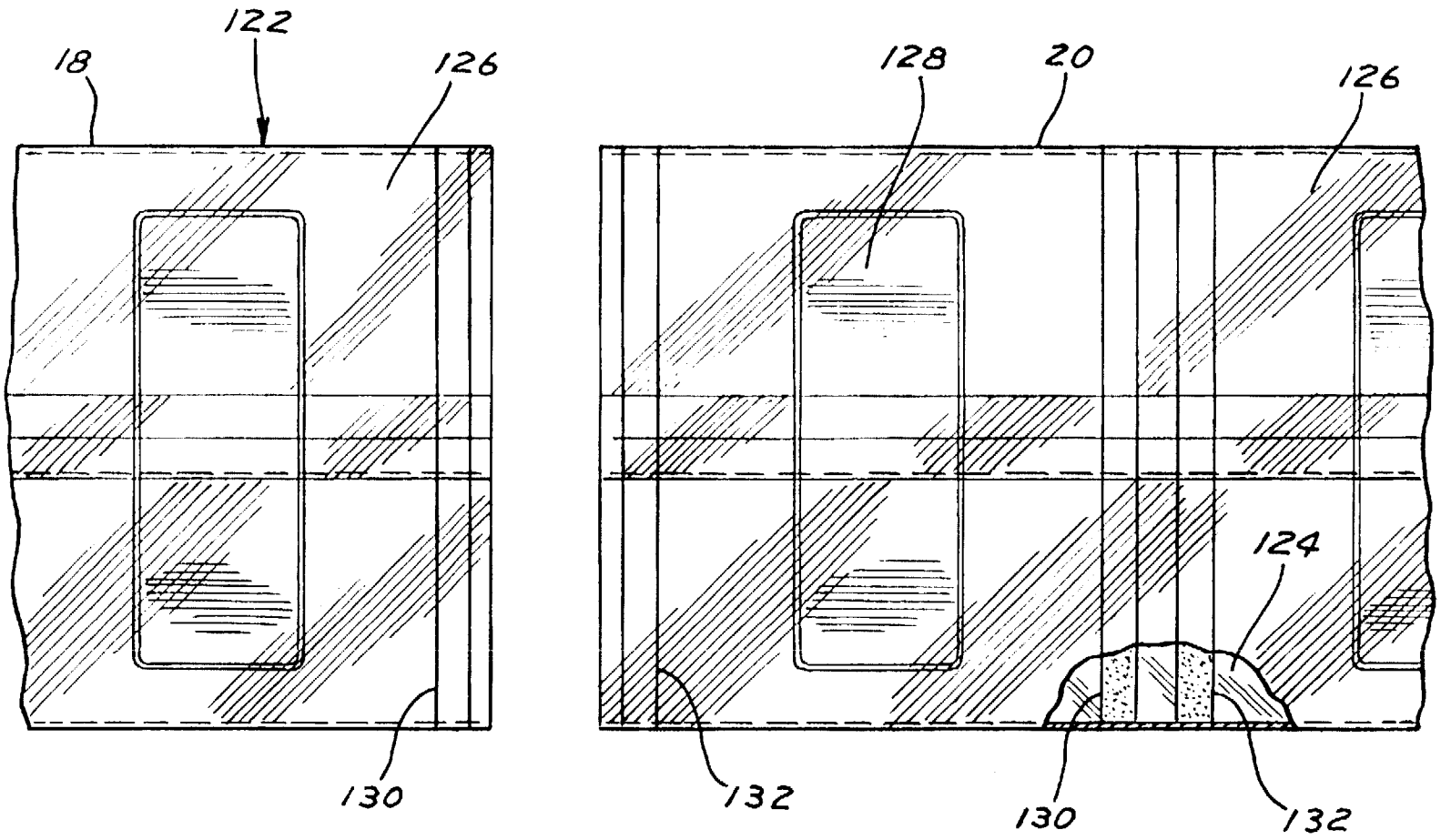
FIG. 4 shows a partial, top view of a most preferred form of a bandolier utilized in the apparatus of FIG. 1, with an initial premium item being severed from the leading edge of the bandolier.

Delivery section 16 generally extends from section 14 to a packaging machine 50 in the most preferred form. Machine 50 generally includes suitable provisions for conveying a plurality of cartons 52 or similar receptacles at spaced intervals along a path 53 which in the preferred form is generally perpendicular to and in the plane of the path of bandolier 20 on vacuum conveyor 26 and parallel to the leading and trailing edges of item 18 and of blade 46. Cartons 52 have at least a first open end which extends in a plane perpendicular to path 27 and the plane of path 27 of bandolier 20 on vacuum conveyor 26 and closely adjacent delivery section 16. In a preferred embodiment as best seen in FIG. 2, delivery section 16 is in the form of a slide surface 54, with the individual premium item 18 being propelled by blade 46 to slide on slide surface 54 and into the open end of carton 52. In an alternate embodiment as best seen in FIG. 3, delivery section 16 is in the form of a high speed vacuum conveyor 56. Conveyor 56 generally includes a continuous belt 58 including an array of apertures extending therethrough. Belt 58 passes over a vacuum box 60 which is under vacuum. Thus, the vacuum tends to draw and hold any articles on the top surface of belt 58 and in section 16 captures and conveys individual premium items 18 toward machine 50.

In the most preferred form, the linear speed of belt 58 on the top surface of vacuum box 60 is considerably greater than the linear speed of belt 28 of vacuum conveyor 26 and is at least generally equal to the linear speed of blade 46 at anvil 48 in its cutting position. Generally, delivery section 16 in the form of vacuum conveyor 56 is utilized when the individual premium item 18 has characteristics which prevent blade 46 from providing the necessary momentum to premium item 18 to allow it to slide over slide surface 54 and into the open end of carton 52 in a consistent manner. Such characteristics could include but are not limited to large mass, large wind resistance, a relatively soft, sticky, or similar bottom surface 124, and the like.

Now that the basic construction of apparatus 10 according to the preferred teachings of the present invention has been set forth, the operation and at least some of the advantages of the present invention can be explained. Specifically, packaging machines 50 move cartons 52 along path 53, with machines 50 currently running at speeds of up to 150 cartons 52 per minute. When it is desired to insert premium items 18 into cartons 52, apparatus 10 is operated to advance bandolier 20 along path 27 to section 14 such that premium item 18 is cut and accelerated by blade 46 for movement into and through delivery section 16 when the open end of carton 52 is located at the intersection of paths 27 and 53 so that the premium item 18 is thereby inserted into carton 52.

After cutting premium item 18 from bandolier 20, shaft 40 is rotated by servo-motor 42 from its cutting position to a control position where it is held or waits until sensor 38 indicates that bandolier 20 has moved on path 27 for a distance so that rotation of shaft 40 will cause blade 46 to cut the leading premium item 18 from bandolier 20. Thus, movement of blade 46 is controlled by movement of bandolier 20. However, in the preferred form, the speed of rotation of blade 46 is always the same every time blade 46 is at the cutting position and independent of the linear speed of bandolier 20, with rotation of blade 46 being timed to cut bandolier 20 between seals 130 and 132 and specifically at the trailing edge of the leading premium item 18 and the leading edge of the remaining portion of bandolier 20. Thus, the time that blade 46 remains in the control position varies with the speed of bandolier 20 along path 27 and thus also the speed of cartons 52 along path 53. The rotational spacing of the control position to the cutting position must be sufficient for servo-motor 42 to accelerate shaft 40 such that blade 46 reaches the required linear speed at its cutting position even if rotation of shaft 40 has stopped in the control position. It should be appreciated that the radial distance of blade 46 from shaft 40 can be designed so that blade 46 never really stops in the control position but may merely slows down at the control position while the controller checks the timing and position of blade 46, with rotation of shaft 40 to and from the control position being momentary when cartons 52 move in path 53 at their optimum speed and without interspersion of defective cartons 52 or spaces in production path 53.

In the most preferred form shown, only a single blade 46 is utilized in apparatus 10 having a control position at generally a 3 o'clock position. However, it should be noted that section 14 could utilize more than one blade 46 with a corresponding number of control positions. As an example, two blades 46 could be provided on diametrically opposite sides of shaft 40 with control positions at the 3 and 9 o'clock positions. Use of multiple blades 46 on a single shaft 40 is especially desirable for high insertion rates. It should be appreciated that shaft 40 must be spaced above bottom strip 124 of bandolier 20 in the feed path by a distance greater than the height of premiums 128 above bottom strip 124 and holder 44 and blade 46 must be designed according to the teachings of the present invention to allow passage of bandolier 20 without interference between shaft 40, holder 44 and blade 46 and anvil 48 or other engagement with the rotary cutter.

It should be noted that vacuum conveyor 26 is controlled or slaved to packaging machine 50. Thus, as examples, if the speed of cartons 52 in path 53 is less than optimum, the speed of vacuum conveyor 26 is reduced to deliver premium items 18 to sections 14 and 16 to match when cartons 52 cross path 27. Likewise, if defective receptacles are interspersed with satisfactory receptacles in a random manner in a plurality of receptacles moving in production path 53 such as if packaging machine 50 should for instance omit a particular carton 52 leaving only a space in path 53 or if a particular carton 52 is detected as being otherwise defective, vacuum conveyor 26 can be stopped so that no premium item 18 is delivered to the defective receptacle or space in path 53 but premium items 18 are delivered into satisfactory receptacles or cartons 52 on either side of that defective space. It should be appreciated that when vacuum conveyor 26 is stopped so that movement of bandolier 20 stops and as servo-motor 42 is controlled by the movement of bandolier 20, servo-motor 42 also stops rotation of shaft 40 and holds blade 46 in its control position until movement of bandolier 20 occurs and to allow blade 46 to engage bandolier 20 between seals 130 and 132.

Another major advantage of the use of servo-motor 42 is its ability to sense when greater torque loads are being placed on shaft 40 than a set normal. Specifically, in the event that shaft 40 is rotated so that blade 46 engages bandolier 20 at the location of a premium 128 rather than at a location between premiums 128 in bandolier 20, greater cutting force is required by blade 46 and thus greater torque is required on shaft 40 than normal. Whenever servo-motor 42 senses a greater than normal torque load, rotation of shaft 40 is stopped to prevent damage to blade 46. But more importantly, operation of vacuum conveyor 26 and of packaging machine 50 is stopped and will not start until after resetting allowing the operator to determine the cause of the problem and make suitable corrections.

Although in the preferred form the linear speed of blade 46 at its cutting position when cutting bandolier 20 at anvil 48 is substantially greater than the linear speed of bandolier 20, blade 46 can be rotated such that when initially engaging and cutting bandolier 20, blade 46 has a linear speed which is generally equal to the linear speed of bandolier 20. Blade 46 can be rapidly accelerated after cutting bandolier 20 to have a linear speed which is substantially greater than the linear speed of bandolier 20 to provide a kick to cut premium item 18 and thereby accelerate or shoot cut premium item 18. Bandolier 20 can thereby be severed with a cleaner cut and with reduced stress on blade 46.

It should be appreciated that as sections 12, 14, and 16 always operate in the same direction and specifically not requiring change in direction, apparatus 10 according to the teachings of the present invention is able to cut and insert premium items 18 at speeds at least comparable to the operational speeds of packaging machine 50. Thus, only a single apparatus 10 is needed for each packaging machine 50 minimizing the floor space requirements for premium insertion. Additionally, the length required for feed section 12 and of conveyor 56 along path 27 must only be sufficient to allow belts 28 and 58 to capture bandolier 20 and premium item 18, respectfully. As an example, vacuum conveyor 26 having a length in the range of 12 to 36 inches (0.3 to 1 meter) and preferably in the range of 12 to 18 inches (0.3 to 0.5 meter) is sufficient to capture and hold bandolier 20. Likewise, slide surface 54 can have a length along path 27 sufficient only to prevent physical interference between cartons 52 and/or packaging machine 50 and section 14. Thus, the floor space requirements can be further minimized according to the teachings of the present invention.

Additionally, due to the mechanically simple design and operation without change in direction, minimal operational problems are encountered and minimal operational supervision is required. Specifically an operator's attention should only be necessary to reset in the event that servo-motor 42 detects greater torque loads on shaft 40, in the event that tote 22 has been depleted requiring that a full tote 22 be replaced, or similar problems. In this regard, the controller can stop operation of apparatus 10 (and thus of packaging machine 50) in the event that vacuum conveyor 26 is operating but optical sensor 38 does not detect movement of bandolier 20. Thus, efficiency losses of packaging machine 50 as the result of apparatus 10 should be minimal. Also, operating costs as the result of apparatus 10 should only slightly increase as the operator for packaging machine 50 should also be able to supervise operation of apparatus 10 according to the teachings of the present invention due to its minimal operational supervision requirements.

Additionally, since apparatus 10 according to the preferred teachings of the present invention has continuous motion in the same direction, apparatus 10 is not a significant source of vibration. Thus, operational speeds are not limited and wear is not accelerated as the result of vibration. Further, minimal vibrations are transmitted to packaging machine 50 which could affect the performance thereof.

Further, due to its relatively simple mechanical construction, the cost of fabricating apparatus 10 according to the teachings of the present invention is substantially less than the fabrication costs of only one prior mechanical placement machine even though only one apparatus 10 has the operational speed at least equivalent to three prior mechanical placement machines. Thus, the capital costs are also reduced if it is desired to insert a premium item during product production.

It should also be noted that bandoliers 20 fed by feeding section 12 do not require indexing notches as was required by many prior mechanical placement machines. Thus, efficiency for the production of bandolier 20 should increase and the production costs for bandolier 20 should decrease when apparatus 10 according to the teachings of the present invention is utilized.

Although explained in connection with inserting premium items 18 into packaging in the form of cartons 52, apparatus 10 according to the teachings of the present invention can be utilized in other environments where automatic insertion of items 18 which can be fabricated into and/or cut from bandolier 20 is desired. As an example, apparatus 10 could be utilized to cut item 18 in the form of a frosting pouch for insertion into a package including the other ingredients for a cake mix. In still another application, apparatus 10 according to the teachings of the present invention could be utilized to insert a dried cheese or sauce packet for a dried pasta or dried potato product.

Likewise, although only a single item 18 was described for insertion into cartons 52, two or more apparatus 10 could be utilized to insert multiple items 18. As an example, a first apparatus 10 could be utilized to insert a frosting pouch and a second apparatus 10 could be utilized to insert a pouch including nuts into packaging including the other ingredients for a cake mix.

Alternately, while apparatus 10 of the most preferred form has been shown with a single bandolier 20 being fed to section 14, a skilled artisan will appreciate that in other variations, a plurality of bandoliers 20 can be simultaneously fed (e.g. side-by-side). Bandoliers 20 in such an arrangement can, of course, include items 18 of different sizes and/or types. To cut and accelerate items 18 from the simultaneously fed bandoliers 20, multiple blades 46 could be provided on the rotary cutter which are not necessarily aligned with one another but rather could be on different arc segments on the rotary cutter.

Similarly, although believed to have special application for the direct insertion of items 18 into cartons 52 especially in the food industry, apparatus 10 according to the preferred teachings of the present application may be applicable to similar environments where placement of items 18 into a production path at accurate intervals is desired. For example, pouches or packets of fasteners, other hardware, or parts can be conveniently added to disassembled equipment packaging. Likewise, items 18 could be placed in buckets which collect multiple items 18 and/or components which in turn are subsequently added to the final product.

Likewise, although having special application for insertion of premium items 18 which are cut from bandolier 20 in the form of a strip of preformed premium items 18 in the most preferred form, apparatus 10 according to the teachings of the present invention can be utilized to cut items 18 from a bandolier 20 in the form of continuous stock which does not have readily identifiable divisions or separations until items 18 are formed by cutting such continuous stock. Such use of apparatus 10 could have particular application in formation of components which are added to or assembled with other components in the formation of the final product.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Device for inserting an item having a leading edge and a trailing edge, with a plurality of items being connected together in a serial manner in a bandolier with the trailing edge of an initial item being integrally secured to the leading edge of the next item in the bandolier, comprising, in combination: means for feeding the bandolier in a feed direction and along a feed path and at a linear feed speed in the feed path; a rotary cutter including a shaft having a cutting blade extending across the feed path and parallel to the leading and trailing edges; and means for rotating the shaft to a cutting position so that the blade engages the bandolier between the trailing edge of the initial item and the leading edge of the next item to cut the bandolier therebetween and so that the blade pushes and accelerates the cut item in an acceleration direction perpendicular to the blade.

2. The device of claim 1 wherein the rotating means rotates the shaft so that the blade has a linear cutting speed when cutting the bandolier, with the linear cutting speed of the blade being greater than the linear feed speed of the bandolier in the feed path.

3. The device of claim 2 wherein the rotating means rotates the shaft so that the linear speed of the blade is the same every time the blade cuts the bandolier independent of the linear feed speed of the bandolier.

4. The device of claim 3 wherein the rotating means comprises a servo-motor, with the servo-motor rotating the shaft to a control position after the cutting position and then holding the shaft in the control position until the bandolier moves in the feed direction sufficiently for the servo-motor to be able to rotate the shaft from the control position to the cutting position so that the blade is accelerated to the linear cutting speed by the servo-motor when reaching the cutting position.

5. The device of claim 1 for inserting the item into a carton, with the cartons moving in a carton path generally parallel to the blade and at a linear carton speed in the carton path, with the item being cut, pushed, and accelerated by the blade for movement into the carton moving in the carton path.

6. The device of claim 5 further comprising, in combination: a delivery section extending between the blade in the cutting position and the carton, with the item being pushed into the delivery section by the blade.

7. The device of claim 6 wherein the delivery section comprises a slide surface extending between the blade in the cutting position and the carton when the carton is positioned in the carton path at its intersection with the acceleration direction.

8. The device of claim 7 wherein the cutting blade extends perpendicular to the feed direction and the acceleration direction is contiguous to the feed direction.

9. The device of claim 6 wherein the delivery section comprises a delivery conveyor including a belt having a top surface for receiving the item cut by the blade from the bandolier, with the top surface of the belt having a linear speed considerably greater than the linear feed speed and at least equal to the linear cutting speed of the blade after cutting the bandolier.

10. The device of claim 9 wherein the delivery conveyor comprises a vacuum conveyor with the belt passing over a vacuum box which is under vacuum and including an array of holes so that the vacuum tends to draw and hold the item on the top surface of the belt.

11. The device of claim 5 wherein the feeding means feeds the bandolier at the linear feed speed which is related to the linear carton speed.

12. The device of claim 11 further comprising, in combination: an optical sensor for sensing movement of the bandolier in the feed path, with the rotating means being controlled by the optical sensor.

13. The device of 1 wherein the feeding means comprises a feed conveyor including a belt having a top surface for receiving the bandolier.

14. The device of claim 13 wherein the feed conveyor comprises a vacuum conveyor with the belt passing over a vacuum box which is under vacuum and including an array of holes so that the vacuum tends to draw and hold the bandolier on the top surface of the belt.

15. The device of claim 14 wherein the feeding means further comprises, in combination: means for sandwiching the bandolier on the top surface of the belt.

16. The device of claim 15 wherein the sandwiching means comprises, in combination: an overhead conveyor including a continuous belt having a lower surface having a linear speed equal to the linear feed speed; and elements carried by the belt of the overhead conveyer for engaging the bandolier.

17. The device of claim 15 wherein the bandolier is supplied in a tote, with the feed path and the leading and trailing edges of the item being horizontal, with the tote located vertically below the feed path; and wherein the feeding means further comprises, in combination: an idler wheel with the bandolier extending from the tote around the idler wheel and onto the top surface of the belt of the feed conveyor, with the idler wheel acting as a guide for insuring that the bandolier extends in the feed path on the top surface of the belt of the feed conveyor.

18. The device of claim 1 wherein the rotating means rotates the shaft so that the blade has a linear cutting speed when cutting the bandolier, with the linear cutting speed of the blade when initially engaging and cutting the bandolier being generally equal to the linear feed speed of the bandolier in the feed path and then being accelerated to greater than the linear feed speed of the bandolier in the feed path after cutting the bandolier to provide a kick to the cut item.

19. Method for inserting an item having a leading edge and a trailing edge comprising the steps of: providing a rotary cutter including a shaft having a cutting blade; feeding a plurality of items connected together in a serial manner in a bandolier with the trailing edge of an initial item being integrally secured to the leading edge of the next item in the bandolier, with the bandolier being fed in a feed direction and along a feed path and at a linear feed speed in the feed path, with the blade extending across the feed path and parallel to the leading and trailing edges; and rotating the shaft to a cutting position so that the blade engages the bandolier between the trailing edge of the initial item and the leading edge of the next item to cut the bandolier therebetween and so that the blade pushes and accelerates the cut item in an acceleration direction perpendicular to the blade.

20. The method of claim 19 wherein the rotating step comprises the step of rotating the shaft so that the blade has a linear cutting speed when cutting the bandolier, with the linear cutting speed of the blade being greater than the linear feed speed of the bandolier in the feed path.

21. The method of claim 20 wherein the rotating step comprises the step of rotating the shaft so that the linear speed of the blade is the same every time the blade cuts the bandolier independent of the linear feed speed of the bandolier.

22. The method of claim 21 further comprising the step of: moving a plurality of cartons serially in a carton path generally parallel to the blade and at a linear carton speed in the carton path, with the rotating step cutting, pushing and accelerating the item by the blade for movement into the carton moving in the carton path.

23. The method of claim 22 wherein the feeding step comprises the step of feeding the plurality of items at the linear feed speed which is related to the linear carton speed.

24. The method of claim 23 further comprising the step of: sensing movement of the bandolier in the feed path, with the rotating step comprising the step of rotating the shaft related to the sensed movement of the bandolier in the feed path.

25. The method of claim 21 wherein the rotating step comprises the steps of: rotating the shaft to a control position after the cutting position; holding the shaft in the control position; and rotating the shaft from the control position when the bandolier moves in the feed direction for a distance, with the control position being sufficiently spaced from the cutting position to allow the shaft to be accelerated to the linear cutting speed when reaching the cutting position.

26. The method of claim 25 wherein the holding step comprises the step of holding the shaft in the control position without stopping rotation of the shaft in the control position, with rotation of the shaft to and from the control position being momentary.

27. The method of claim 19 wherein the rotating step comprises the step of rotating the shaft so that the blade has a linear cutting speed when cutting the bandolier, with the linear cutting speed of the blade when initially engaging and cutting the bandolier being generally equal to the linear feed speed of the bandolier in the feed path and then being accelerated to greater than the linear feed speed of the bandolier in the feed path after cutting the bandolier to provide a kick to the cut item.

28. Device for inserting an item into a satisfactory receptacle moving in a production path at a variable linear production speed, with the satisfactory receptacle moving in the production path with a plurality of receptacles including defective receptacles interspersed with satisfactory receptacles in a random manner, with items being desired to be inserted into the satisfactory receptacles and not to be inserted into the defective receptacles, with each item having a leading edge and a trailing edge, with a plurality of items being connected together in a serial manner in a bandolier with the trailing edge of an initial item being integrally secured to the leading edge of the next item in the bandolier, comprising, in combination: means for feeding the bandolier in a feed direction and along a feed path and at a linear feed speed in the feed path, with the feed path being at a nonparallel angle to the production path; a rotary cutter including a shaft having a cutting blade extending across the feed path and parallel to the leading and trailing edges; and a servo-motor for rotating the shaft to a cutting position so that the blade engages the bandolier between the trailing edge of the initial item and the leading edge of the next item to cut the bandolier therebetween for insertion along an insertion path into the next satisfactory receptacle in the production path, with the insertion path intersecting the production path at an intersection, with the feeding means feeding the bandolier at the linear speed which is variable according to the linear production speed and the existence of defective receptacles in the production path so that the item is cut and inserted into the satisfactory receptacle when the satisfactory receptacle is in the production path at the intersection with the insertion path even though the satisfactory receptacles move in the production path at the variable production speed and move with the defective receptacles interspersed with the satisfactory receptacles; wherein the servo-motor rotates the shaft so that the blade has a linear speed sufficient to push and accelerate the cut item in an acceleration direction perpendicular to the blade, with the linear speed of the blade being greater than the linear feed speed of the bandolier in the feed path.

29. The device of claim 28 wherein the servo-motor rotates the shaft to a control position after the cutting position and then holds the shaft in the control position until the bandolier moves in the feed direction to an extent that rotation of the shaft from the control position engages the blade with the bandolier between the trailing edge of the initial item and the leading edge of the next item.

30. The device of claim 29 wherein the servo-motor holds the shaft in the control position until the bandolier moves in the feed direction sufficiently for the servo-motor to be able to rotate the shaft from the control position to the cutting position so that the blade is accelerated to the linear blade speed by the servo-motor when reaching the cutting position.

31. The device of claim 30 wherein the linear speed of the blade is the same every time the blade cuts the bandolier independent of the linear feed speed of the bandolier.

32. The device of claim 28 further comprising, in combination: an optical sensor for sensing movement of the bandolier in the feed path, with the servo-motor being controlled by the optical sensor.

33. The device of claim 28 for inserting the item into the satisfactory receptacle in the form of a carton.

34. The device of claim 28 further comprising, in combination: a delivery section extending between the blade in the cutting position and the receptacles moving in the production path, with the item being pushed into the delivery section by the blade.

35. Method for inserting an item having a leading edge and a trailing edge, comprising the steps of: moving a plurality of receptacles in a production path at a variable linear production speed, with the plurality of receptacles including satisfactory receptacles and defective receptacles interspersed with the satisfactory receptacles in a random manner, with items being desired to be inserted into the satisfactory receptacles and not to be inserted in the defective receptacles; feeding a plurality of items connected together in a serial manner in a bandolier with the trailing edge of an initial item being integrally secured to the leading edge of the next item in the bandolier, with the bandolier being fed in a feed direction and along a feed path and at a linear feed speed in the feed path, with the feed path being at a nonparallel angle to the production path; providing a rotary cutter including a shaft having a cutting blade extending across the feed path and parallel to the leading and trailing edges; and rotating the shaft to a cutting position so that the blade engages the bandolier between the trailing edge of the initial item and the leading edge of the next item to cut the bandolier therebetween for insertion along an insertion path into the next satisfactory receptacle in the production path, with the insertion path intersecting the production path at an intersection, with the bandolier being fed at the linear speed which is variable according to the linear production speed and the existence of defective receptacles in the production path so that the item is cut and inserted into the satisfactory receptacle when the satisfactory receptacle is in the production path at the intersection with the insertion path even though the satisfactory receptacles move in the production path at the variable production speed and with defective receptacles interspersed with satisfactory receptacles; wherein the rotating step comprises the step of rotating the shaft so that the blade has a linear speed sufficient to push and accelerate the cut item in an acceleration direction perpendicular to the blade, with the linear speed of the blade being greater than the linear feed speed of the bandolier in the feed path.

36. The method of claim 35 wherein the rotating step comprises the step of rotating the shaft so that the linear speed of the blade is the same every time the blade cuts the bandolier independent of the linear feed speed of the bandolier.

37. Device for cutting a bandolier into individual items, with the bandolier including a continuous longitudinally elongated carrier having a bottom surface and a plurality of three dimensional objects mounted to the carrier in a longitudinally spaced manner, with the three-dimensional objects having a longitudinal length and a height above the bottom surface, comprising, in combination: means for feeding the bandolier in a feed direction and along a feed path and at a variable linear feed speed in the feed path; a rotary cutter including a shaft having at least a first cutting blade extending across the feed path, with the shaft being spaced above the bottom surface of the bandolier in the feed path by a distance greater than the height of the objects above the bottom surface; and a servo-motor for rotating the shaft to a cutting position so that the blade engages the bandolier between the objects to cut the bandolier therebetween, with the blade positioned on the shaft so that the shaft can be rotated and the bandolier can be fed without engagement of the blade with the objects, with the rotation of the shaft by the servo-motor being controlled by the movement of the bandolier in the feed path; wherein the servo-motor rotates the shaft so that the blade has a linear speed sufficient to push and accelerate in an acceleration direction perpendicular to the blade the portion of the bandolier cut from the bandolier, with the linear speed of the blade being greater than the linear feed speed of the bandolier in the feed path.

38. The device of claim 37 wherein the servo-motor rotates the shaft to a control position after the cutting position and then holds the shaft in the control position until the bandolier moves in the feed direction to an extent that rotation of the shaft from the control position engages the blade with the bandolier between the objects.

39. The device of claim 37 further comprising, in combination: an optical sensor for sensing movement of the bandolier in the feed path, with the servo-motor being controlled by the optical sensor.

40. The device of claim 37 wherein the carrier includes a top surface secured to the bottom surface, with the objects located intermediate the top and bottom surfaces.

41. The device of claim 40 wherein the bottom surface includes first and second longitudinal edges and the top surface includes first and second longitudinal edges integrally formed with the first and second longitudinal edges of the bottom surface; and wherein the carrier includes a first trailing seal and a second leading seal extending between the bottom and top surface and between the first and second longitudinal edges, with the first and second seals located longitudinally intermediate the objects mounted to the carrier, with the blade engaging the bandolier between the first and second seals.

42. The device of claim 37 wherein the first and second seals are longitudinally spaced from each other and from the objects.

43. The device of claim 37 wherein the linear speed of the blade is the same every time the blade cuts the bandolier independent of the linear feed speed of the bandolier.

* * * * *